US011639660B2

(12) United States Patent
Chen et al.

(10) Patent No.: US 11,639,660 B2
(45) Date of Patent: May 2, 2023

(54) REAL-TIME PUMP DIAGNOSTIC ALGORITHMS AND APPLICATION THEREOF

(71) Applicant: Ravdos Holdings Inc., New York, NY (US)

(72) Inventors: Zengshi Chen, Missouri City, TX (US); Doneil Macusi Dorado, Missouri City, TX (US); Eric Oestreich, Missouri City, TX (US); Gary Hughes, Missouri City, TX (US); Andy Cordova, Missouri City, TX (US)

(73) Assignee: RAVDOS HOLDINGS INC., New York, NY (US)

( * ) Notice: Subject to any disclaimer, the term of this patent is extended or adjusted under 35 U.S.C. 154(b) by 1782 days.

(21) Appl. No.: 14/443,878

(22) PCT Filed: Nov. 19, 2013

(86) PCT No.: PCT/US2013/070780
§ 371 (c)(1),
(2) Date: May 19, 2015

(87) PCT Pub. No.: WO2014/078851
PCT Pub. Date: May 22, 2014

(65) Prior Publication Data

US 2015/0275651 A1 Oct. 1, 2015

Related U.S. Application Data

(60) Provisional application No. 61/727,894, filed on Nov. 19, 2012.

(51) Int. Cl.
*E21B 47/008* (2012.01)
*F04B 49/06* (2006.01)
(Continued)

(52) U.S. Cl.
CPC ..... *E21B 47/008* (2020.05); *E21B 47/009* (2020.05); *E21B 47/09* (2013.01); *F04B 47/02* (2013.01); *F04B 49/065* (2013.01)

(58) Field of Classification Search
CPC .. H04L 25/03057; F04B 49/02; F04B 47/026; E21B 47/0008; E21B 47/18
(Continued)

(56) References Cited

U.S. PATENT DOCUMENTS 3,998,568 A * 12/1976 Hynd ..... F04B 49/02 417/12
5,252,031 A 10/1993 Gibbs
(Continued)

FOREIGN PATENT DOCUMENTS

CN 87205901 U 4/1988
CN 101305187 A 11/2008
(Continued)

OTHER PUBLICATIONS

Gibbs, "Predicting the Behavior of Sucker-Rod Pumping Systems" pp. 769-778.*
(Continued)

*Primary Examiner* — Catherine T. Rastovski
*Assistant Examiner* — Kaleria Knox
(74) *Attorney, Agent, or Firm* — Dentons Cohen & Grigsby P.C.

(57) ABSTRACT

A method for determining a pump card for a well. The method comprising: obtaining a first set of data points, wherein the first set of data points comprise a first set of polished rod position data points of the well and a first set of polished rod load data points of the well; and calculating a first data point of a pump position and a pump load using the first set of data points. The calculating occurs before the well moves through a first complete stroke cycle.

14 Claims, 10 Drawing Sheets

(51) Int. Cl.
*F04B 47/02* (2006.01)
*E21B 47/009* (2012.01)
*E21B 47/09* (2012.01)

(58) Field of Classification Search
USPC ..... 375/265; 702/6; 417/12; 340/854.3
See application file for complete search history.

(56) References Cited

U.S. PATENT DOCUMENTS

| | | | | |
|---|---|---|---|---|
| 5,314,016 | A * | 5/1994 | Dunham | E21B 47/0008 417/12 |
| 6,041,856 | A | 3/2000 | Thrasher et al. | |
| 2003/0065447 | A1* | 4/2003 | Bramlett | E21B 47/009 702/6 |
| 2007/0211812 | A1* | 9/2007 | Del Angel | H04L 25/03057 375/265 |
| 2009/0311107 | A1 | 12/2009 | Chavez Zapata | |
| 2011/0184567 | A1 | 7/2011 | Sonnier | |
| 2012/0025997 | A1 | 2/2012 | Liu et al. | |
| 2013/0030721 | A1* | 1/2013 | Palka | F04B 47/026 702/41 |
| 2013/0154845 | A1* | 6/2013 | Brooks | E21B 47/18 340/854.3 |

FOREIGN PATENT DOCUMENTS

| | | | | |
|---|---|---|---|---|
| CN | 101960087 | A | 1/2011 | |
| CN | 102337866 | A | 2/2012 | |
| CN | 102402184 | A | 4/2012 | |
| WO | 2010051270 | A1 | 5/2010 | |
| WO | WO 2010051270 | A1 * | 5/2010 | F04B 49/065 |
| WO | WO-2010051270 | A1 * | 5/2010 | E21B 47/0008 |
| WO | WO 2011124978 | A2 * | 10/2011 | E21B 47/12 |
| WO | WO-2011124978 | A2 * | 10/2011 | E21B 47/12 |
| WO | 2012082081 | A2 | 6/2012 | |

OTHER PUBLICATIONS

Office Action issued in connection with corresponding EP Application No. 13811650.4 dated May 10, 2017.

First Office Action and Search issued in connection with corresponding CN Application No. 201380060375.0 dated Jun. 26, 2017.

Gibbs et al., "Computer Diagnosis of Down-Hole Conditions in Sucker Rod Pumping Wells", Journal of Petroleum Technology, vol. No. 18, Issue No. 1, pp. 91-98, Jan. 1966.

Lukasiewicz, "Computer Model Evaluates Oil Pumping Units in Inclined Wells", The Journal of Canadian Petroleum Technology, vol. No. 29, Issue No. 6, pp. 76-79, Nov.-Dec. 1990.

Lukasiewicz, "Dynamic Behavior of the Sucker Rod String in the Inclined well", Proceedings of Production Operations Symposium, SPE, pp. 313-321, Apr. 1991.

Everitt et al., "An Improved Finite-Difference Calculation of Downhole Dynamometer Cards for Sucker-Rod Pumps", SPE Production Engineering, pp. 121-127, Feb. 1992.

Gibbs, "Design and Diagnosis of Deviated Rod-Pumped Wells", Journal of Petroleum Technology, vol. No. 44, Issue No. 7, pp. 774-781, Jul. 1992.

Xu et al., "Diagnostic Analysis of Deviated Rod-Pumped Wells", Proceedings of Southwestern Petroleum Short Course, pp. 133-140, 2001.

Vasserman et al., "Formulation and Solution of Dynamic Problems of Elastic Rod Systems Subjected to Boundary Conditions Described by Multivalued Relations", Journal of Applied Mechanics and Technical Physics, vol. No. 44, Issue No. 3, pp. 406-414, 2003.

Shardakov et al., "Numerical Modelling of Longitudinal Vibrations of a sucker Rod String", Journal of Sound and Vibration, vol. No. 329, pp. 317-327, 2010.

Pons-Ehimeakhe, "Modified Everitt-Jennings Algorithm With Dual Iteration on the Damping Factors", Proceedings of Southwestern Petroleum Short Course, Apr. 2012.

PCT Search Report and Written Opinion issued in connection with corresponding Application No. PCT/US2013/070780 dated Jul. 8, 2014.

Guoan, Y., et al "The Two Methods of Solving One-Dimensional Diagnostic Model for Sucker-Rod Pumping Wells," Journal of Xi'an Petroleum Institute, vol. 4, Issue No. 4, pp. 9-15, (Dec. 31, 1989).

Extended European Search Report and Opinion issued in connection with corresponding EP Application No. 17202438.2 dated Apr. 6, 2018.

* cited by examiner

REAL-TIME PUMP DIAGNOSTIC ALGORITHMS AND APPLICATION THEREOF

BACKGROUND OF THE INVENTION

Embodiments of the invention disclosed and taught herein relate generally to pump diagnostic methods, and more specifically, real-time and near real-time pump diagnostic techniques and approaches for use with rod pump and similar well pumping systems.

The modern pump diagnostic technique for vertical oil wells was originated by Gibbs in 1966 [Gibbs, S. G., et al., Journal of Petroleum Technology, Vol. 18 (1), pp. 91-98 (1966)]. Gibbs used the method of separation of variables to generate the explicit solution of the pump position which satisfied the constraints of the measured polished rod position and load. In 1987, Jennings applied the finite difference method to the wave equation of the vertical wells and obtained some pump cards that were similar to the ones through the method of separation of variables [Everitt, T. A., et al., SPE Production Engineering, pp. 121-127 (February 1992)]. In 1991, Lukasiewicz obtained the solution to the wave equation of the rod strings of some deviated wells through the finite element method by considering the axial and transversal motions [Lukasiewicz, S. A., Journal of Canadian Petroleum Technology, Vol. 29 (6), pp. 76-79 (1990); Lukasiewicz, S. A., Proc. Of Production Operations Symposium, April 1991, Oklahoma City, Okla.; pp. 313-321]. In 1992, Gibbs proposed a diagnostic solution to the deviated wells by including the Coulomb friction in the wave equation [Gibbs, S. G., Journal of Petroleum Technology, Vol. 44 (7), pp. 774-781 (1992)]. In 2001, Xu reinforced Gibbs' diagnostic approach to the deviated wells [Xu, J., et al., Proc. Southwestern Petroleum Short Course, pp. 133-140 (2001)]. In 2003 and 2010, Shardakov and Vasserman studied the stick-slip phenomenon of the deviated wells through the variational inequalities [Shardakov, I. N., et al., Journal of Sound and Vibrations, Vol. 329 pp. 317-327 (2010); Vassserman, I. N., et al., Journal of Mechanics and Technical Physics, Vol. 44 (3), pp. 406-414 (2003)]. In 2012, Pons-Ehimeakhe studied the vertical and deviated wells by including Coulomb friction or considering different viscous damping values in the up and down strokes in the finite difference method to the wave equation [Pons-Ehimeakhe, V., Proc. Southwestern Petroleum Short Course, Lubbock, Tex. (April 2012)].

In the aforementioned approaches, the data points of the polished rod position and load of a stroke cycle are acquired and displayed first. Then, the diagnostic algorithm is executed to obtain the pump position and load. There is a time delay between displaying the pump card and displaying the surface card. In general, the time delay between the display of the first data point of the pump card and the display of the first data point of the surface card is between one stroke cycle and two stroke cycles. The delay time is the accumulation of the polished rod stroke cycle, the time spent on filtering and interpolation of the polished rod data, and the time spent on executing the diagnostic algorithm. There is a demand in oil industry for displaying the pump card in real-time or near real-time. The instant disclosure addresses the issue of displaying a pump card in real-time or near real-time mode using several real-time or near real-time diagnostic techniques and methods, including the finite difference and Fourier series solutions to the wave equation of the rod string in a well. The real-time pump diagnostic technique provides the real-time or near real-time pump information, advances the pump-off control action by about half the pumping cycle, and may be useful for the active speed control of the oil pump.

With the finite difference method, the technique for calculating the pump card in real-time is developed, and the simulation results are reported. With the Fourier series method, by using the periodicity of the signal, the pump data point (pump position and pump load) at any time point is obtained, and the surface and pump data points can be displayed and erased synchronously. The wave propagation delay law is applied so that the pump motion is delayed at a proper time relative to the polished rod motion.

Embodiments of the invention disclosed and taught herein are directed to techniques for displaying a pump card in real-time or near real-time synchronization with a surface card, and the implementation of such methods and techniques.

BRIEF SUMMARY OF THE INVENTION

The objects described above and other advantages and features of the invention are incorporated in the application as set forth herein, and the associated appendices and drawings, related to systems for analyzing, diagnosing, and displaying (on a surface card, pump card, or both) data from pumping units and the like, particularly in real-time or near real-time.

In accordance with a first embodiment of the present disclosure, real-time and near real-time methods, including both methods of finite difference and Fourier series analysis, for analyzing and displaying pump cards and surface cards are described.

According to another embodiment of the present invention, the polished rod load can be derived from a direct measurement through a load cell or from a calculation through a motor torque.

According to another embodiment of the present invention, the first surface stroke may refer to any stable surface stroke after pumping is started, and it does not necessarily refer to the first surface stroke which occurs immediately after the pumping unit is started.

According to another embodiment of the present invention, any surface data point is displayed once it is measured, and any pump card data point is displayed once it is calculated.

According to another embodiment of the present invention, a surface card is erased only after its cycle is complete, a pump card is erased only after its cycle is complete, the surface card and its corresponding pump card can be erased at the same time or in a sequence with a delay.

According to another embodiment of the present invention, the methods for calculating the pump data points in real-time are provided, the methods calculate and display the current pump data point in the time interval between the last surface data point and the current surface data point, and the methods calculate the data points of the first pump card before or when the first surface stroke is completed.

According to another embodiment of the present invention, part or the complete set of the data points of the first surface stroke are used to calculate the first pump data point. Data points may include but are not limited to data points that may be measured, derived or inferred, such as position, load, pressure, motor torque, or motor current.

According to another embodiment of the present invention, a real-time pump card point can be obtained every few surface data points to give more time for executing the real-time pump diagnostic algorithms, and the real-time pump diagnostic algorithms are suitable for strokes with a varying number of data points.

According to another embodiment of the present invention, the real-time pump diagnostic methods are applicable to vertical wells, horizontal wells and deviated wells with single or multi-taper rod strings.

According to another embodiment of the present invention, the real-time pump diagnostic methods provide prompt diagnostic of the pump conditions, and prompt control of the pump.

Other and further objects, features and advantages will be apparent from the following description of a presently preferred embodiment of the invention, given for the purpose of disclosure and taken in conjunction with the accompanying drawings.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein, wherein.

DETAILED DESCRIPTION OF THE INVENTION

Figure 1:
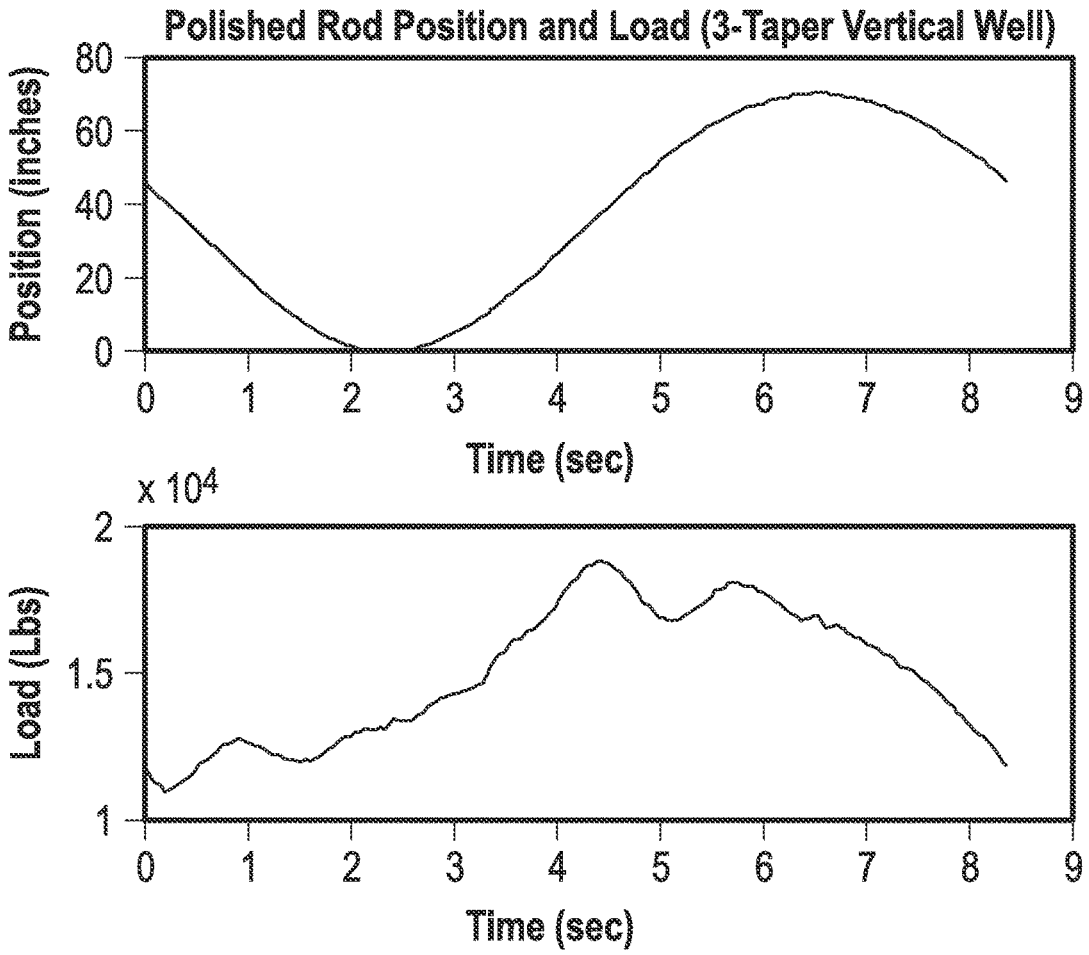
FIG. 1 illustrates a graphical representation of a polished rod position and load for a vertical well with a three-taper rod string

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

The following definitions are provided in order to aid those skilled in the art in understanding the detailed description of the present invention.

The term "substantially real time", or "near real time", as used herein, refers to a short period of time between process steps. Preferably, something that occurs in "substantially real time" occurs within a time period of less than 10 seconds, more preferably less than 5, 4, 2, 1, 0.5, 0.2, 0.1, 0.01 seconds, or less. In one particular embodiment, computing an algorithm or pump card metric is performed in substantially real time relative to when the activity measurement used to compute the metric was taken.

The term "near real-time" or "nearly real-time" (NRT), in the present disclosure, refers to the time delay introduced, by automated data processing or network transmission, between the occurrence of an event and the use of the processed data, such as for display or feedback and control purposes. For example, a near-real-time display depicts an event or situation as it existed at the current time minus the processing time, as nearly the time of the live event.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left,"

"right," "upper," "lower," "down," "up," "side," and the like are used in the written description for clarity in specific reference to the Figures and are not intended to limit the scope of the invention or the appended claims.

Particular embodiments of the invention may be described below with reference to block diagrams and operational illustrations of methods. It will be understood that each block of the block diagrams and operational illustrations, and combinations of blocks in the block diagrams and operational illustrations, can be implemented by analog and digital hardware, and computer program instructions. Such computer program instructions may be provided to a processor of a general-purpose computer, special purpose computer, ASIC, and other programmable data processing system. The executed instructions may create structures and functions for implementing the actions specified in the block diagrams and operational illustrations. In some alternate implementations, the functions/actions/structures noted in the figures may occur out of the order noted in the block diagrams and operational illustrations. For example, two operations shown as occurring in succession, in fact, may be executed substantially concurrently or the operations may be executed in the reverse order, depending upon the functionality/acts/structure involved.

Applicants have created real-time and near real-time pump diagnostic techniques and methods to generate a pump motion capable of lagging the polished rod motion, or being synchronous with the polished rod motion. Such methods may also detect the incomplete pump fillage and other pump conditions in a timely manner.

The following are examples of real-time and near real-time pump diagnostic techniques and methods to generate a pump motion capable of lagging the polished rod motion, or being synchronous with the polished rod motion using the finite deference equations. In this example, a generalized model for the deviated well is developed. The model is:

$$\frac{\partial^2 u}{\partial t^2} = v^2 \frac{\partial^2 u}{\partial x^2} - c\frac{\partial u}{\partial t} - \frac{144 g_c}{\rho A} C(x, t) \tag{1}$$

where C(x, t) is the Coulomb friction force on the rod segment of unit length and varies over time at every node in lbs/ft; t is the time in seconds; u(x,t) is the rod displacement (deformation) in ft at the axial distance x and the time t; A is the rod cross-sectional area in $in^2$;

$$c = \frac{\pi v \lambda}{2L}$$

is the viscous damping coefficient in 1/s; λ is the dimensionless damping factor; L is the total rod length in ft;

$$v = \sqrt{\frac{144 g_c E}{\rho}}$$

is the sound velocity in the rod material in ft/s; ρ is the density of the rod material in $lbm/ft^3$; $g_c$ is the gravity conversion factor in (lbm·ft)/(lbf·$sec^2$); E is Young's modulus of elasticity for the rod material in psi; ∂u/∂x is the rod strain, e.g., the change of the rod displacement over the axial rod length.

The finite difference equation for the system is $$u(x+\Delta x, t) = H_1 u(x, t+\Delta t) - H_2 u(x, t) + H_3 u(x, t-\Delta t) - u(x-\Delta x, t) + H_4 C(x, t) \tag{2}$$

where $$H_1 = \frac{(\rho A + 144 c g_c \Delta t)\Delta x^2}{144 E A g_c \Delta t^2},$$

$$H_2 = \frac{2\rho \Delta x^2}{144 E g_c \Delta t^2} + \frac{c\rho \Delta x^2}{144 E g_c \Delta t} - 2,$$

$$H_3 = \frac{\rho \Delta x^2}{144 E g_c \Delta t^2} \text{ and } H_4 = \frac{\Delta x^2}{AE}.$$

Equation (2) is solved for the current pump position and load in every sampling time interval. For the vertical well application, one makes $H_4$ as 0 in Equation (2) and has $$u(x+\Delta x,t)=H_1 u(x,t+\Delta t)-H_2 u(x,t)+H_3 u(x,t-\Delta t)-u(x-\Delta x,t) \tag{3}$$

Exemplary polished rod data cycles as referenced herein are discussed as follows. For example, a beam pump unit may have many input sensors to the Well Manager controller. Well Manager™ is a Lufkin product. The input sensors may be used in the display of a real-time pump card. The first input may be from a magnet that monitors the motor revolution. Polished rod position or load data point may correspond to a complete motor revolution which is sensed by this magnet. The second input may be from the other magnet that sends a signal to the controller at the end of a complete stroke cycle. The data acquired between the two input signals of the second magnet may represent the data that spans a stroke cycle of the polished rod. The surface and pump cards may be erased once the second magnet is triggered. The polished rod position and load with respect to time may be illustrated for a vertical well with a three-taper rod string. Examples of each of these embodiments follows:

FIG. 1 is an exemplary illustration of a polished rod position and load for a real vertical well with a three-taper rod string. This well is named as Well 1. In this exemplary example, the number of the data points of the polished rod position or load is 205. The well parameters are listed in Table 1. In this exemplary example, the polished rod position takes the substantially full, or complete, sinusoidal wave form. In this exemplary example, the pump Pillage is complete.

TABLE 1

| Parameter | Value | Unit |
|---|---|---|
| RodDiameter | [0.875, 0.75, 0.875] | inches |
| RodModulus | [30.5, 30.5, 30.5] | mega-psi |
| WeightPerFoot | [2.224, 1.634, 2.224] | lbs/feet |
| LengthOfTaper | [3092, 4175, 450] | feet |
| TubingGradient | 0.36 | psi/foot |
| SPM | 5.32 | stroke per minute |
| PumpDepth | 7717 | feet |
| RodDamping | 0.1 | dimensionless |
| StrokeLength | 70.1 | inches |
| StuffingBoxFriction | 100 | lbs |
| TubingHeadPressure | 100 | lbs |

The details of the technique for using the live surface data points to generate the live pump data points under the finite difference method in accordance with the present disclosure is presented herein. The M polished rod position or load points for a stroke cycle are assumed and the 2N−3 data points for both polished rod position and load that are required for obtaining a pump card data point (position and load) is assumed. Two parameters are:

M=the number of polished rod position or load samples in a stroke cycle;

N=the number of nodes along the rod string.

Once a surface or pump card is complete, it may be immediately erased. To have a complete cycle of data for the pump card, more than one cycle of data for the polished rod may be needed. The additional data of the polished rod may come from the next cycle. It may use the 2N−3 beginning data points of the next surface cycle to calculate the 2N−3 ending data points of the current pump cycle.

Figure 2:
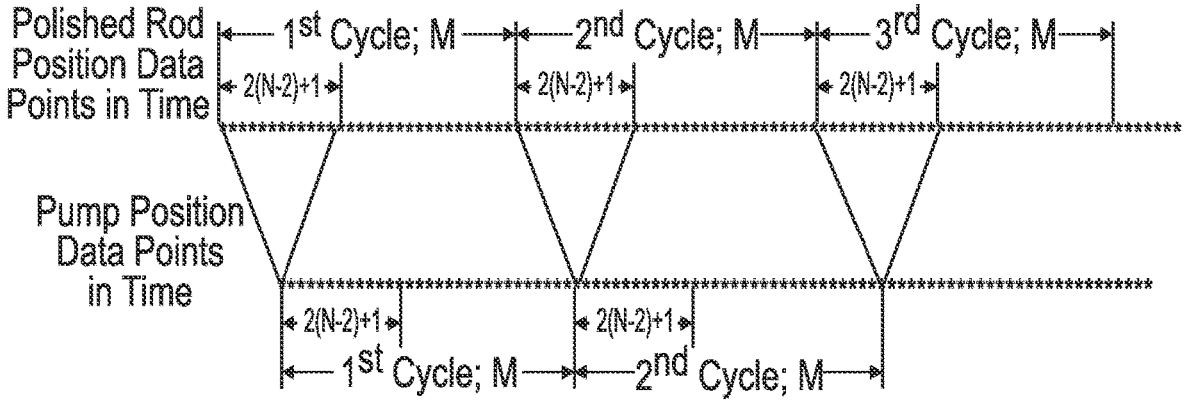
FIG. 2 illustrates a graphical representation of the displaying and erasing a surface and pump card with a time delay as an exemplary embodiment of a method for implementing the inventions described herein.

FIG. 2 illustrates the sequences of the polished rod position and the relevant pump position. A surface data point may be displayed as soon as it is available. Once M surface data points are displayed, the surface card may be erased and the surface card for the next stroke cycle may start to be displayed. Once the first 2N−3 data points of the polished rod position and load of the first stroke are available, the first data point of the pump card may be immediately calculated and displayed. Then, the moving triangular window as shown in FIG. 2 may be advanced in time by one data point step since the $(2N-2)^{th}$ surface data point is available. With this new array of 2N−3 surface data points, the second pump data point may be calculated and displayed. Data shifting, calculation and displaying may continue until M pump data points are displayed. Then, a pump cycle is completed, the pump card may be erased and the pump card for the next stroke cycle may start to be displayed.

Figure 3:
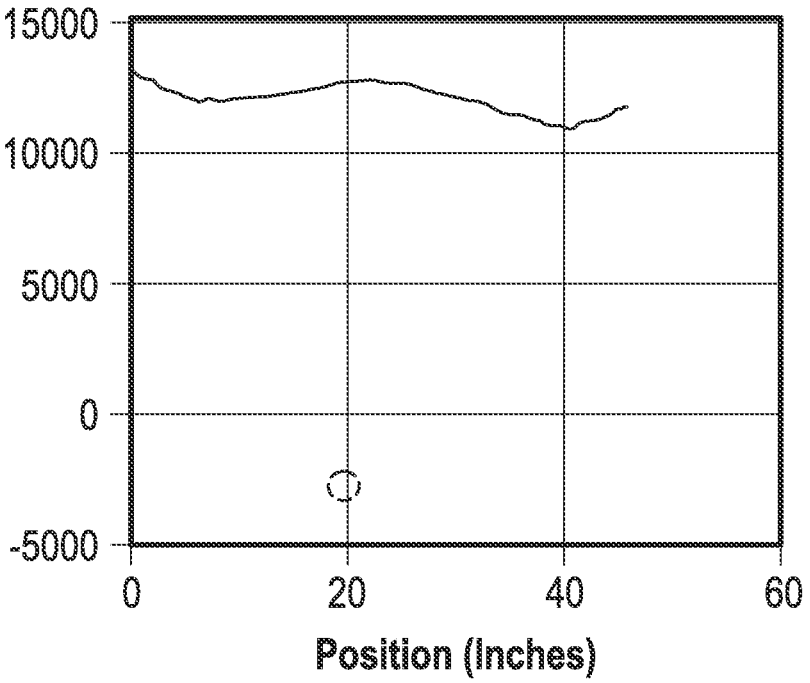
FIG. 3 illustrates the surface and pump cards of Well 1 when the first pump data point is obtained and displayed.

An exemplary Well 1 may be simulated. In FIG. 3, the 2N−3 points of the surface card of the exemplary Well 1 are being displayed and the first pump card data point is calculated and displayed. In this example, the closing of the surface card is ahead of closing of the pump card. Either card may be erased once it is completed.

Figure 4:
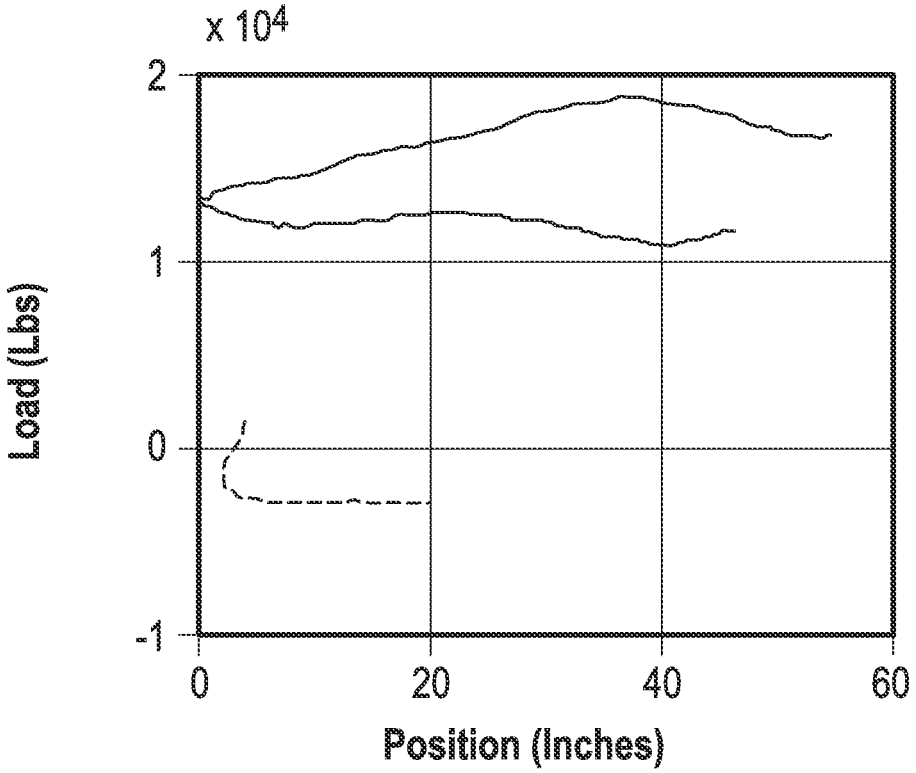
FIG. 4 illustrates the surface and pump cards of Well 1 when dozens of pump data points are obtained and displayed.

In FIG. 4, the beginning of the pump card is being displayed. Displaying of the surface card is ahead of displaying of the pump card.

Figure 5:
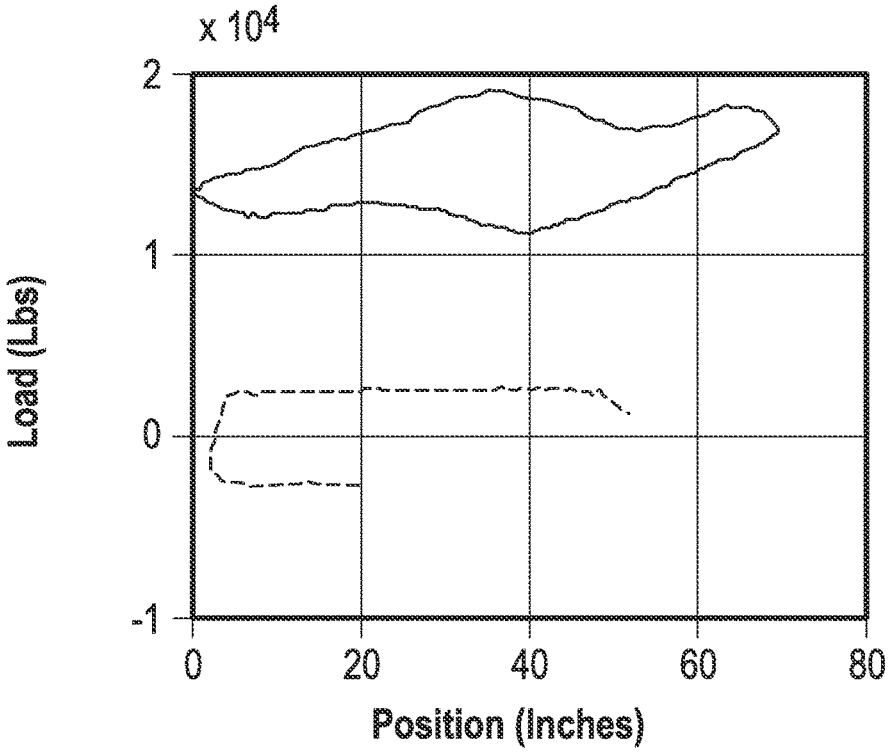
FIG. 5 illustrates the surface and pump cards of Well 1 when most of the data points of a pump cycle are obtained and displayed.

FIG. 5 illustrates that at a time point which is the integer multiplication of M, the surface card of Well 1 is completed but the pump card is not completed.

Figure 6:
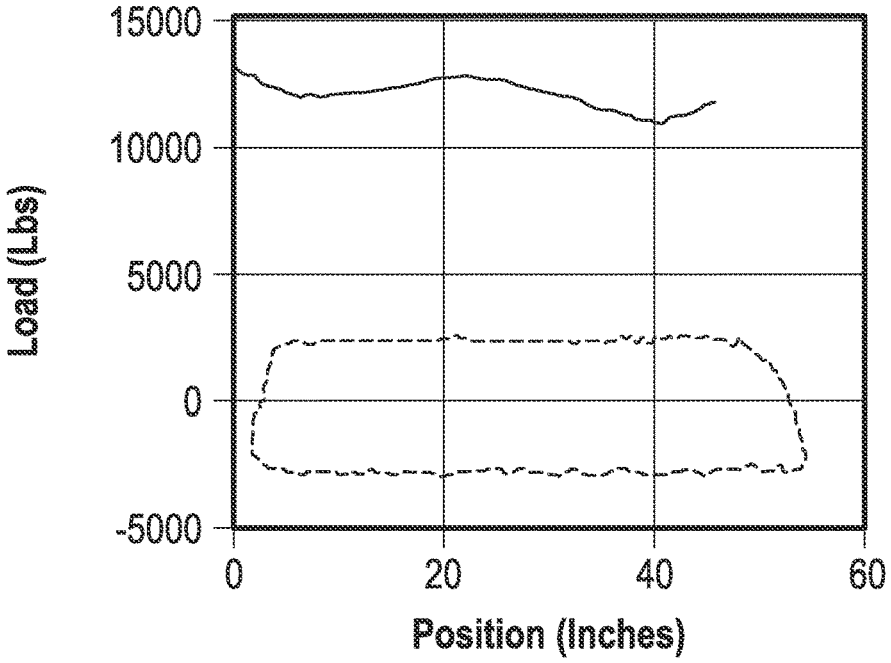
FIG. 6 illustrates the complete first pump card and some beginning points of the second surface card of Well 1.

FIG. 6 illustrates that the pump card of Well 1 for its stroke cycle is complete when the 2N−3 surface card data points for its next stroke cycle are acquired and displayed.

With the conventional finite difference method, one has to calculate the node displacement on every grid along the time axis. However, some of these nodes are useless to computation of the pump displacement. Therefore, a smart algorithm may be designed to avoid the computation of these useless grids. The smart algorithm can save at least 50% of the conventional computation time. With N as defined in the previous sections, we need 2N−3 surface data points to compute a point for the pump card. With the conventional method, we need to calculate (N−2)(2N−3) grid points in order to have a data point for the pump card. With the new algorithm, we only need to calculate $(N-2)^2$ grid points. The time percentage which is saved is at least:

$$100\% \lim_{N\to\infty} \frac{(N-2)(2N-3)-(N-2)^2}{(N-2)(2N-3)} = 100\% \lim_{N\to\infty} \frac{(N-1)(N-2)}{(N-2)(2N-3)} = 100\% \lim_{N\to\infty} \frac{N-1}{2N-3} = 100\% \lim_{N\to\infty} 0.5\left(1+\frac{1}{2N-3}\right) = 100\% * 0.5 = 50\% \tag{4}$$

where N as a total number of the rod string nodes is greater than 2. Since $$\frac{1}{2N-3}$$

is a monotonous decreasing function, the time percentage which is saved is at least greater than 50%. Using a 7 node rod string as an example, the time which is saved can be represented by:

$$100\% * 0.5\left(1+\frac{1}{2*5-3}\right) = 54.6\%. \tag{5}$$

The grid table for a data point of the pump card is shown in Table 2. The horizontal grids are along the time axis. The vertical grids are along the rod string position axis. b represents the grids of the node 1 and 2 as the boundary conditions. X represents the useless grids which need no calculation. U represents the grids which have to be solved in order to get a data point of the pump node. In this case, the grid on the coordinates (6,7) will be solved. The conventional finite difference method has to solve 55 grid points. However, the new algorithm proposed in this report needs to solve only 25 grid points.

TABLE 2

| | | | | | | | | | | | |
|---|---|---|---|---|---|---|---|---|---|---|---|
| 1 | b | b | b | b | b | b | b | b | b | b | b |
| 2 | b | b | b | b | b | b | b | b | b | b | b |
| 3 | X | U | U | U | U | U | U | U | U | U | X |
| 4 | X | X | U | U | U | U | U | U | U | X | X |
| 5 | X | X | X | U | U | U | U | U | X | X | X |
| 6 | X | X | X | X | U | U | U | X | X | X | X |
| 7 | X | X | X | X | X | U | X | X | X | X | X |

The discussion and details presented herein proposes two techniques for calculating the pump card in synchronization with its surface card under the finite difference method. The first technique synchronously displays and erases the surface and pump cards. The second technique displays the data point of a surface or pump card as soon as it is available and erases a card once it is completed. Either technique can be refined. The proposed techniques provide the closed pump cards based on which pump condition can be diagnosed or pump can be shut off or made slow. Moreover, calculation of the useless data grid points in the finite difference iteration may be avoided. The computational efficiency may be doubled. The real-time pump card can also be applied to the Fourier series platform, as is discussed below.

The details of the generation and application of an exemplary Fourier series technique in accordance with the present disclosure is presented herein. The Fourier series equations for real-time pump diagnostic are developed. The technique for displaying and erasing a pump card and its surface card simultaneously is developed.

The following is an example of real-time and near real-time pump diagnostic techniques and methods to generate a pump motion capable of being synchronous with the polished rod motion using wave equations and Fourier series transforms.

Let a=v in Equation (1). For the vertical well application, one makes C(x,t) as 0 in Equation (1) and has $$\frac{\partial^2 u}{\partial t^2} = a^2 \frac{\partial^2 u}{\partial x^2} - c\frac{\partial u}{\partial t}. \tag{6}$$

To develop the basic solution, u is replaced by a complex variable z(x,t). Equation (6) becomes $$\frac{\partial^2 z(x,t)}{\partial t^2} = a^2 \frac{\partial^2 z(x,t)}{\partial x^2} - c\frac{\partial z(x,t)}{\partial t}. \tag{7}$$

The Fourier series equation of the polished rod displacement is:

$$U(wt) = \frac{v_0}{2} + \sum_{n=1}^{m} [v_n \cos(nwt) + \delta_n \sin(nwt)]. \tag{8}$$

The Fourier series equation of the polished rod load is:

$$D(wt) = \frac{\sigma_0}{2} + \sum_{n=1}^{m} \sigma_n \cos(nwt) + \tau_n \sin(nwt). \tag{9}$$

The overall solution of the system at arbitrary depth x and time t is $$z(x,t) = \xi(\eta x + \zeta) + \sum_{n=1}^{m} R(n,x,t) + i\sum_{n=1}^{m} G(n,x,t). \tag{10}$$

where $R(n,x,t)=O(n,x)\cos(nwt)+P(n,x)\sin(nwt)$, $O(n,x)=[\kappa_n \cos h(\beta_n x)+\delta_n \sin h(\beta_n x)]\sin(\alpha_n x)+[\mu_n \sin h(\beta_n x)+v_n \cos h(\beta_n x)]\cos(\alpha_n x)$, $P(n,x)=[\kappa_n \sin h(\beta_n x)+\delta_n \cos h(\beta_n x)]\cos(\alpha_n x)-[\mu_n \cos h(\beta_n x)+v_n \sin h(\beta_n x)]\sin(\alpha_n x)$ $G(n,x,t)=0.5\{[\cos(\alpha_n x)e^{-\beta_n x}][\kappa_n \cos(\alpha_n x)e^{\beta_n x}][\kappa_n \cos(nwt)-\mu_n \sin(nwt)]+[\sin(\alpha_n x)e^{-\beta_n x}+\sin(\alpha_n x)e^{\beta_n x}][\kappa_n \sin(nwt)+\mu_n \cos(nwt)]+[\cos(\alpha_n x)e^{-\beta_n x}+\cos(\alpha_n x)e^{\beta_n x}][\mu_n \sin(nwt)-\delta_n \cos(nwt)]+[\sin(\alpha_n x)e^{\beta_n x}-\sin(\alpha_n x)e^{-\beta_n x}][\mu_n \cos(nwt)+\delta_n \sin(nwt)]\}$, $T_c$ is the pumping cycle, $$w = \frac{2\pi}{T_c}$$

is the angular frequency of the polished rod, $$\alpha_n = \frac{nw}{a\sqrt{2}}\sqrt{1+\sqrt{1+\left(\frac{c}{nw}\right)^2}},$$

-continued $$\beta_n = \frac{nw}{a\sqrt{2}}\sqrt{-1+\sqrt{1+\left(\frac{c}{nw}\right)^2}},$$

$$\xi\eta = \frac{\sigma_0}{2EA},\ \xi\zeta = \frac{v_0}{2},\ \kappa_n = \frac{\sigma_n\alpha_n + \beta_n\tau_n}{EA(\alpha_n^2+\beta_n^2)},\ \mu_n = \frac{\sigma_n\beta_n - \alpha_n\tau_n}{EA(\alpha_n^2+\beta_n^2)},$$

$$v_n = \frac{w}{\pi}\int_0^{T_c} U(wt)\cos(nwt)dt,$$

$$\delta_n = \frac{w}{\pi}\int_0^{T_c} U(wt)\sin(nwt)dt,\ \sigma_n = \frac{w}{\pi}\int_0^{T_c} D(wt)\cos(nwt)dt, \text{ and}$$

$$\tau_n = \frac{w}{\pi}\int_0^{T_c} D(wt)\sin(nwt)dt$$

Hence, u(x, t), the subsurface displacement at arbitrary depth x and time t equal to the real part of z(x, t) is $$u(x,t) = \frac{\sigma_0}{2EA}x + \frac{v_0}{2}\sum_{n=1}^{m}[O(n,x)\cos(nwt) + P(n)\sin(nwt)]. \tag{11}$$

The dynamic load F(x, t) at arbitrary depth x and time t is obtained through Hooke's law of $$F(x,t) = EA\frac{\partial u(x,t)}{\partial x}.$$

By inputting Equation (11), the following equation may be found:

$$F(x,t) = \frac{\sigma_0}{2} + \sum_{n=1}^{m}\left[EA\frac{\partial O(n,x)}{\partial x}\cos(nwt) + EA\frac{\partial P(n,x)}{\partial x}\sin(nwt)\right]. \tag{12}$$

where $$EA\frac{\partial O(n,x)}{\partial x} = [\tau_n \sinh(\beta_n x) + EA(\delta_n\beta_n - \alpha_n v_n)\cosh(\beta_n x)]\sin(\alpha_n x) + [\sigma\cosh(\beta_n x) + EA(\alpha_n\delta_n + \beta_n v_n)\sinh(\beta_n x)]\cos(\alpha_n x). \tag{13}$$

$$EA\frac{\partial P(n,x)}{\partial x} = [\tau_n\cosh(\beta_n x) + EA(\delta_n\beta_n - \alpha_n v_n)\sinh(\beta_n x)]\cos(\alpha_n x) - [[\sigma_n\sinh(\beta_n x) + EA(\delta_n\alpha_n + \beta_n v_n)\cosh(\beta_n x)]\sin(\alpha_n x). \tag{14}$$

Rod strings may have different rod sizes. The real-time diagnostic equations should handle these tapered-rod strings. Hence, the notation of the Fourier coefficients is extended to include two subscripts ${}_i\sigma_n$, ${}_i\tau_n$, ${}_i v_n$, and ${}_i\delta_n$ in which the left subscript denotes the $i^{th}$ taper in the tapered rod string and the right subscript denotes the order of the coefficient as previously. The polished rod data are associated with the first rod interval. Therefore, ${}_i\sigma_n$, ${}_i\tau_n$, ${}_i v_n$, and ${}_i\delta_n$ are Fourier coefficients obtained from harmonic analysis of the polished rod load and position. Similarly, we extend notation of O(n,x) and P(n,x) to ${}_iO_n(x)$ and ${}_iP_n(x)$. The recursive formulae are used to solve real time diagnostic problems of the wells with multi-taper rod strings. They are:

$$_{i+1}v_0 = {}_iv_0 + \frac{{}_i\sigma_0 L_i}{E_i A_i} \tag{15}$$

$$_{i+1}v_n = {}_iO_n(L_i) \tag{16}$$

$$_{i+1}\delta_n = {}_iP_n(L_i) \tag{17}$$

$$_{i+1}\sigma_0 = {}_i\sigma_0 \tag{18}$$

$$_{i+1}\sigma_0 = E_i A_i \frac{d_i O_n(L_i)}{dx} \tag{19}$$

$$_{i+1}\tau_n = E_i A_i \frac{d_i P_n(L_i)}{dx} \tag{20}$$

where i=1, 2, . . . , N−1 with N being the number of tapers in the tapered string.

In this Fourier series scheme for real-time pump card calculation, the surface and pump cards are displayed and erased synchronously. The M polished rod displacement or load points for a stroke cycle are assumed. Every sampling time interval should be known. Relative to the current time point, the M−1 past sampling time intervals of the polished rod displacement or load are stored in the memory. The current data point and the past M−1 data points form a cycle of data points. At each time point, the summation of the past M−1 sampling time intervals acts as the dynamic stroke period $T_c$ based on which the angular frequency $w=2\pi/T_c$ required for Fourier series is obtained. There are a full cycle of the pump displacement data points for every Fourier series calculation. Only the last displacement data point that occurs at the time point $t=T_c$ corresponds to the current polished rod displacement data point.

Figure 7:
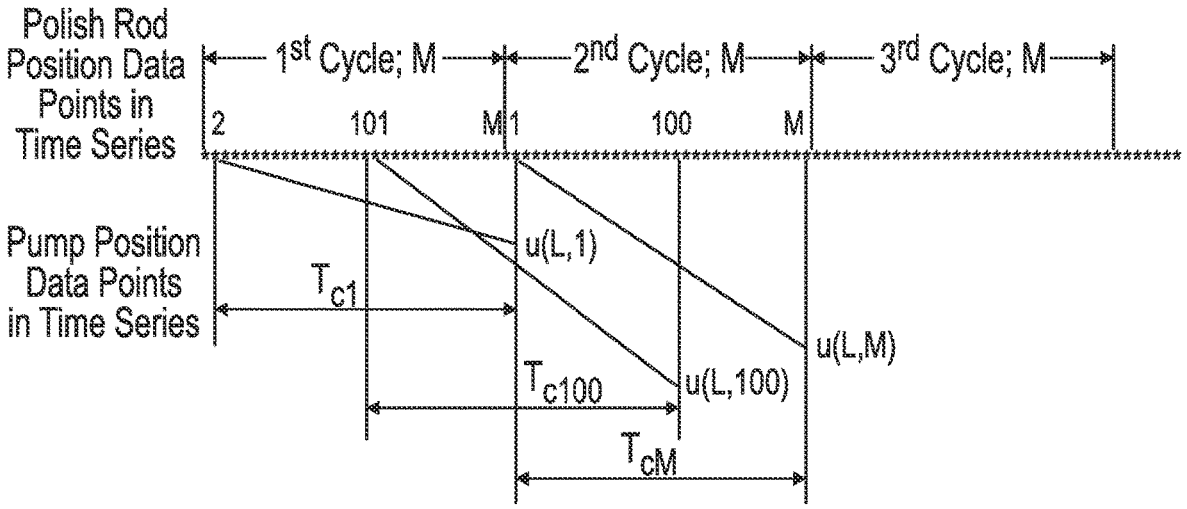
FIG. 7 illustrates the sequences of the polished rod position and the relevant pump position with the Fourier series method as an exemplary embodiment of a method for implementing the inventions described herein.

FIG. 7 is an exemplary illustration of the sequences of the polished rod position and the relevant pump position. With the Fourier series scheme, the data points of the first cycle of the polished rod position and load are displayed but the first pump card is neither calculated nor displayed. Calculations of the three pump positions of the second pump stroke are demonstrated. L is defined as the pump depth.

1) The data points from 2 to M in the first surface stroke and the first data point in the second surface stroke form a surface cycle of data points. The accumulation time period of these sampling time intervals is $T_{c1}$. Based on these M data points and via Equation (11), the Fourier series algorithm is used to calculate the pump position $u(L,T_{c1})$ that corresponds to the $1^{st}$ data point in the second cycle of the polished rod position. $u(L,T_{c1})$ is the first pump position point in the second pump cycle.
2) The data points from 101 to M in the first surface stroke and the data points from 1 to 100 in the second surface stroke form a surface cycle of data points. The accumulation time period of these sampling time intervals is $T_{c100}$, Based on these M data points and via Equation (11), the Fourier series algorithm may be used to calculate the pump position $u(L,T_{c100})$ that corresponds to the $100^{th}$ data point in the second cycle of the polished rod position. $u(L,T_{c100})$ is the $100^{th}$ pump position point in the second pump cycle.
3) The data points from 1 to M in the second surface stroke form a surface cycle of data points. The accumulation time period of these sampling time intervals is $T_{cM}$. Based on these M data points and via Equation (11), the Fourier series algorithm is used to calculate the pump position $u(L,T_{cM})$ that corresponds to the $M^{th}$ data point in the second cycle of the polished rod position. $u(L,T_{cM})$ is the $M^{th}$ pump position point in the second pump cycle.

The corresponding data points of the pump load u(L,t) are calculated through Equation (10). Once completion of the second surface cycle is detected through the input signal of the magnet, the pump card may be completed. The pump-off control algorithm may be executed on part of a pump card and before a complete pump card is obtained, and both the surface and pump cards may be erased simultaneously. The calculation and display of the next pump cycle in synchronization with the next surface cycle may be continued.

Figure 8:
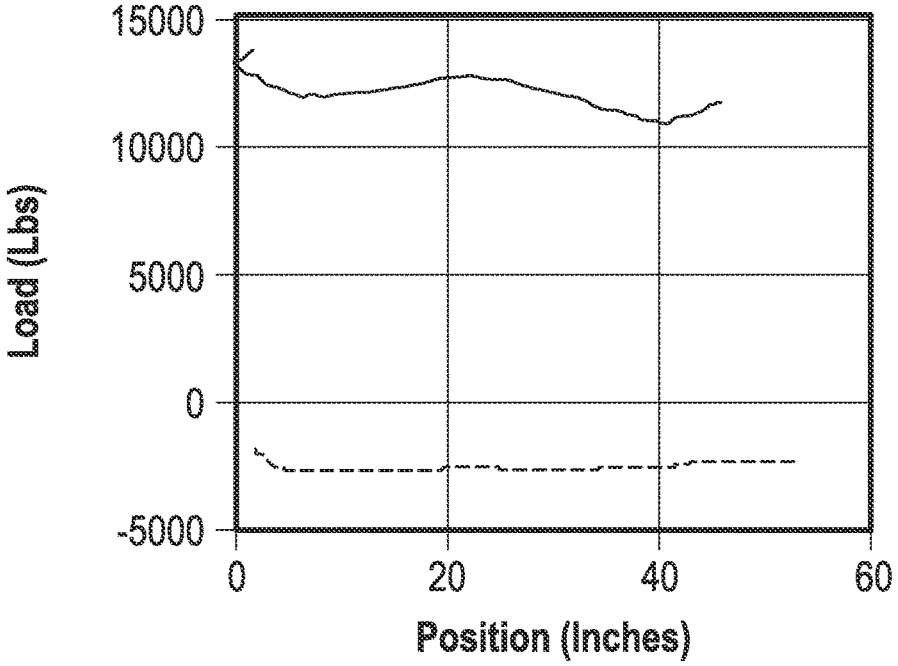
FIG. 8 illustrates the surface and pump cards at the 68th time point of a stroke cycle for Well 1.
Figure 9:
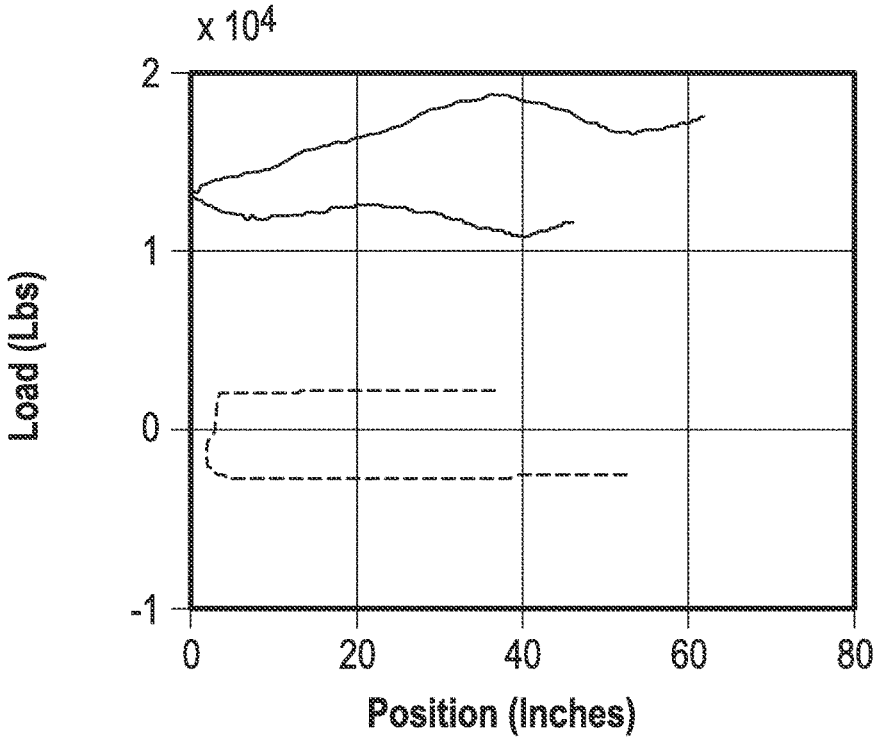
FIG. 9 illustrates the surface and pump cards at $136^{th}$ time point of a stroke cycle for Well 1.
Figure 10:
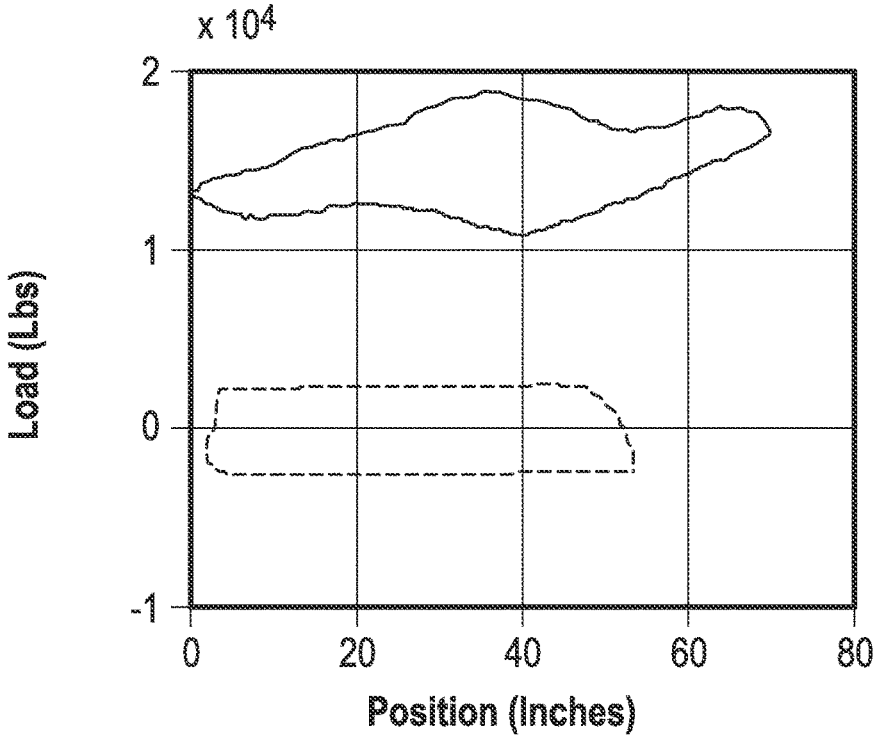
FIG. 10 illustrates the surface and pump cards at the last time point of a stroke cycle for Well 1.

FIGS. 8, 9 and 10 show the surface and pump cards after the first stroke at the $68^{th}$ time point, the $136^{th}$ time point and the last time point of a stroke cycle for Well 1. The surface and pump cards are displayed simultaneously. The pump card obtained is the same as the one obtained via the conventional Fourier series algorithm.

This disclosure proposes a technique for real-time pump diagnostic of the pump conditions of oil wells. The Fourier series algorithm acts as a platform where the new real-time Fourier series algorithm is developed. The current pump position and load corresponding to the current surface position and load are calculated from an amount of current and past surface data points that span a stroke cycle. This technique generates the same quality of the pump cards as the non real-time Fourier series algorithm generates. The proposed technique provides the closed pump cards based on which pump condition can be diagnosed, the pump can be shut off or the pump speed can be changed. By calculating only the pump position at the last time point of a dynamic stroke period, computational efficiency is substantially improved. This fast calculation is helpful to successful implementation of the real-time pump diagnostic technique since the execution time of the whole algorithm is desired to be shorter than any sampling time interval of the surface data.

This disclosure proposes techniques, including those based on the finite difference method or the Fourier series method that may generate the pump motion in real-time or near real-time corresponding to the polished rod motion. The force wave starting at the polished rod driver may not reach the pump instantly. Therefore, the pump motion may lag the polished rod motion by the force wave propagation delay time. This delay time may be so long for a deep well that the pump is still moving in one direction while the polished rod is moving in the opposite direction. For shallow wells, this kind of motion delay phenomenon may be negligible. This disclosure proposes additional methods that map the wave propagation delay time to some parameters in the solutions of the wave equations so that the pump motion properly lags the polished motion in the pump diagnostic. The real-time mode of the pump motion may be approximately obtained.

This disclosure proposes techniques for the implementation of propagation delay time with the finite difference method. The force wave may propagate from the polished rod to the pump by going through a few tapers. The propagation time r is $$\tau = \sum_{i=1}^{m} \tau_i = \sum_{i=1}^{m} L(i)/v(i) \tag{21}$$

where i: the taper index;

L(i): the length of the No. i taper;

v(i): the wave propagation velocity in the No. i taper;

m: the total number of tapers.

The finite difference equation for a rod string may be represented by Equation (2) where u(x, t): rod position at position x and time t;

x: the position of a finite rod segment;

Δx: the interval length between two adjacent nodes along the rod string;

t: time;

Δt: the time interval length between two samples of any position of a rod segment at any position.

A stroke cycle has the M data points. T is defined as the stroke cycle. Δt is determined by:

$$\Delta t = \frac{T}{M-1}. \tag{22}$$

The surface motion lags the pump motion by the following amount of data points:

$$N = \frac{\tau}{\Delta t}. \tag{23}$$

N may be rounded to its nearest integer towards infinity. The number of nodes is approximately 2N. A value for N that is not less than a certain integer value may be required for shallow wells since small 2N may cause the solution to be unstable.

This disclosure proposes techniques for the implementation of propagation delay time with the Fourier Series Method. For every current surface data point, by using a cycle of the current and past surface data points, a full cycle of pump data points may be obtained. For the end of the $i^{th}$ taper, instead of using the last data point of this pump cycle, a data point which has the delay time of $t_i$ may be used. The pump cycle period is defined as T. The propagation delay time to the end of the $i^{th}$ taper is $$t_i = \sum_{p=1}^{i} \tau_p. \tag{24}$$

The depth of the end of the $i^{th}$ taper is $$D_i = \sum_{p=1}^{i} L(p). \tag{25}$$

The Fourier series equation of the rod displacement at the depth $D_i$ and time t is:

$$u(D_i, T-\tau_i) = \frac{{}_i\sigma_0}{2EA} D_i + \frac{{}_i v_0}{2} + \sum_{n=1}^{m} [{}_i O(n, D_i)\cos(nw(T-t_i)) + {}_i P(n)\sin(nw(T-t_i))] \tag{26}$$

The Fourier series equation of the rod load at the depth $D_i$ and time t is:

$$F(D_i, (T-t_i)) = \frac{{}_i\sigma_0}{2} + \sum_{n=1}^{m} \left[ EA \frac{\partial_i O(n, x)}{\partial x}\bigg|_{D_i} \cos(nw(T-t_i)) + EA \frac{\partial_i P(n, x)}{\partial x}\bigg|_{D_i} \sin(nw(T-t_i)) \right]. \tag{27}$$

Figure 11:
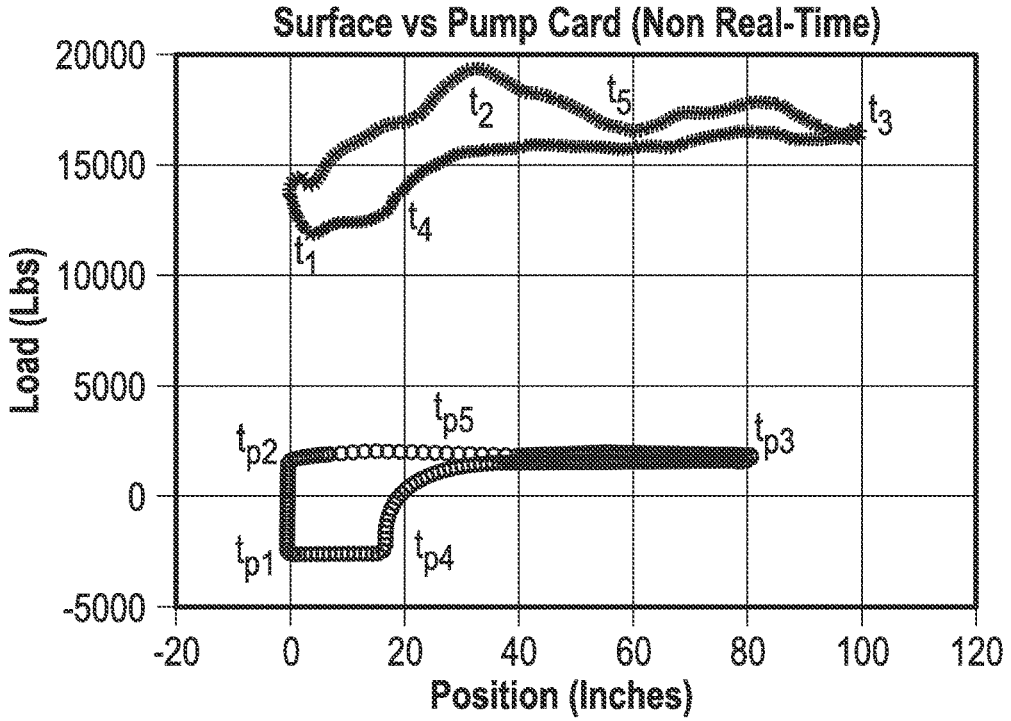
FIG. 11 illustrates the time that is advanced for doing pump-off control.

As shown by the surface card in FIG. 11, the pump card can be divided into the four phases:

a) from time point $t_1$ (traveling valve closes) to time point $t_2$ (standing valve opens).

b) from time point $t_2$ (standing valve opens) to time point $t_3$ (standing valve closes).

c) from time point $t_3$ (standing valve closes) to time point $t_4$ (traveling valve opens).

d) from time point $t_4$ (traveling valve opens) to time point $t_1$ (traveling valve closes).

The pump fillage for this pump card is 20%. With the current pump-off control algorithm, the time point $t_4$ on the surface card corresponds to the critical pump-off point. The surface card starts at the time point $t_1$ that corresponds to the bottom of the down stroke. With the traditional method, after the time point $t_4$ is detected, the controller has to wait for the time interval ($t_1$-$t_4$) between the time point $t_1$ and the time point $t_4$ that is required to complete the stroke cycle and the additional time interval ($t_5$-$t_1$) that is required for executing the algorithm to obtain the pump card. A pump card may be obtained at the time point $t_5$. The time interval between the time point $t_5$ at which the pump is turned off or slowed down and the time point $t_4$ at which the pump-off condition is detected is $$\delta_t = t_5 - t_1 + t_1 - t_4 = t_5 - t_4 \tag{28}$$

With the traditional method, $\delta_t$ is the delay time for switching off or slowing down the pump after the pump-off condition at $t_4$ is detected. If the real-time pump diagnostic method is used, a pump card can be obtained along with the surface card as shown FIG. 7. However, there is a motion delay for the pump relative to the polished rod. Mathematically, the sinusoidal pump motion has a phase delay compared to the sinusoidal polished rod motion. For example, the surface may reach the critical pump-off control point at the time point $t_4$ but the pump may reach the critical pump-off control point at the time point $t_{p4}$. Being the same as the wave propagation time τ, the delay time between the time point $t_4$ and the time point $t_{p4}$ is approximately $$\tau = t_{p4} - t_4 \tag{29}$$

Therefore, compared to the traditional method, the real-time pump diagnostic method can turn off or slow down the pump earlier in an amount of time $\delta_t - \tau$.

Figure 12:
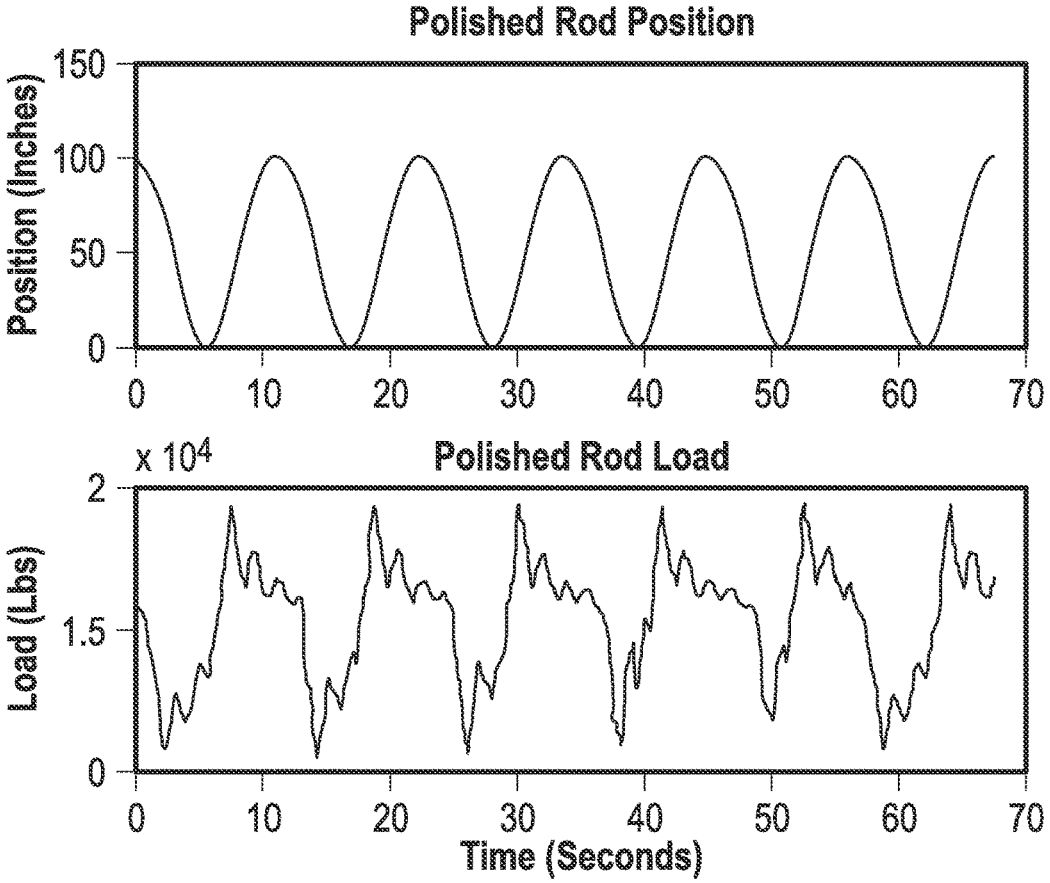
FIG. 12 illustrates the six cycles of the polished rod position and load synthesized from SROD with varied fillages and a varying number of data points in a stroke.
Figure 13:
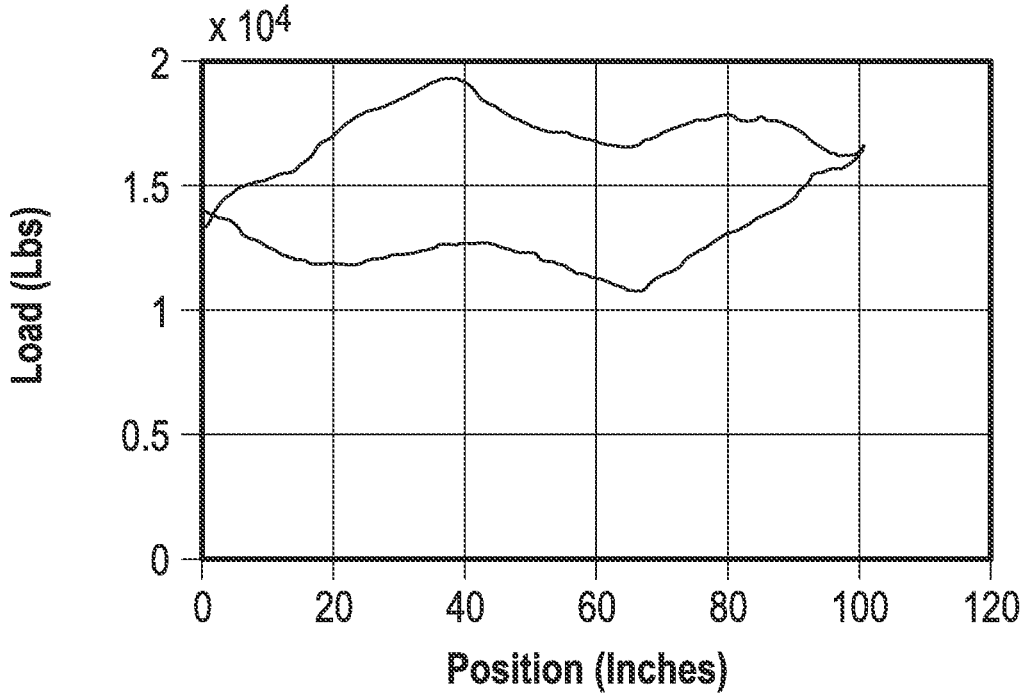
FIG. 13 illustrates the surface card with 100% fillage.
Figure 14:
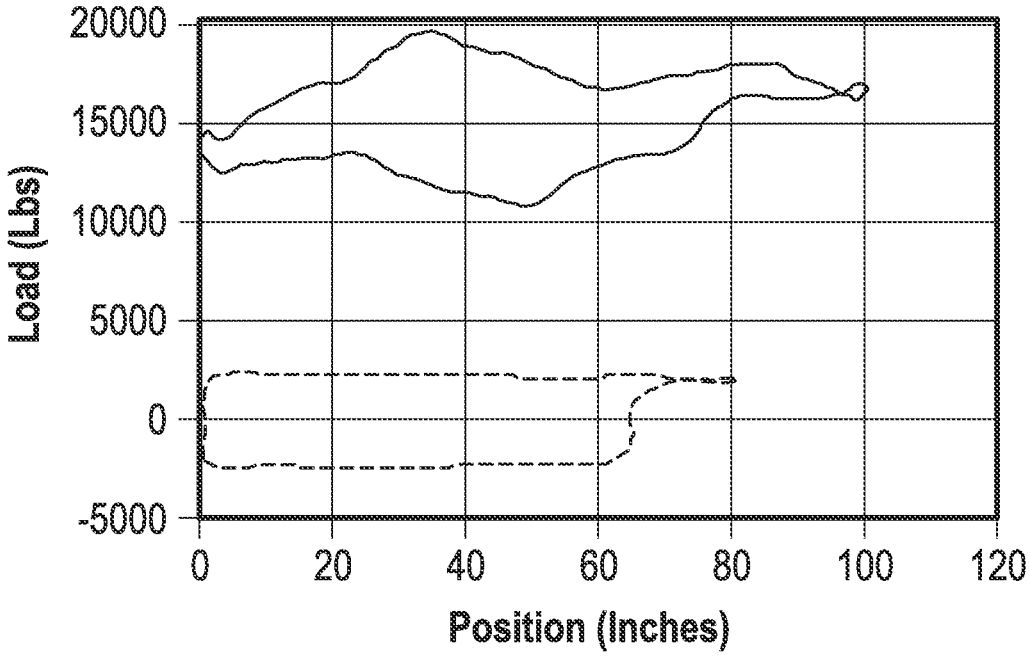
FIG. 14 illustrates the surface and pump cards with 80% fillage.
Figure 15:
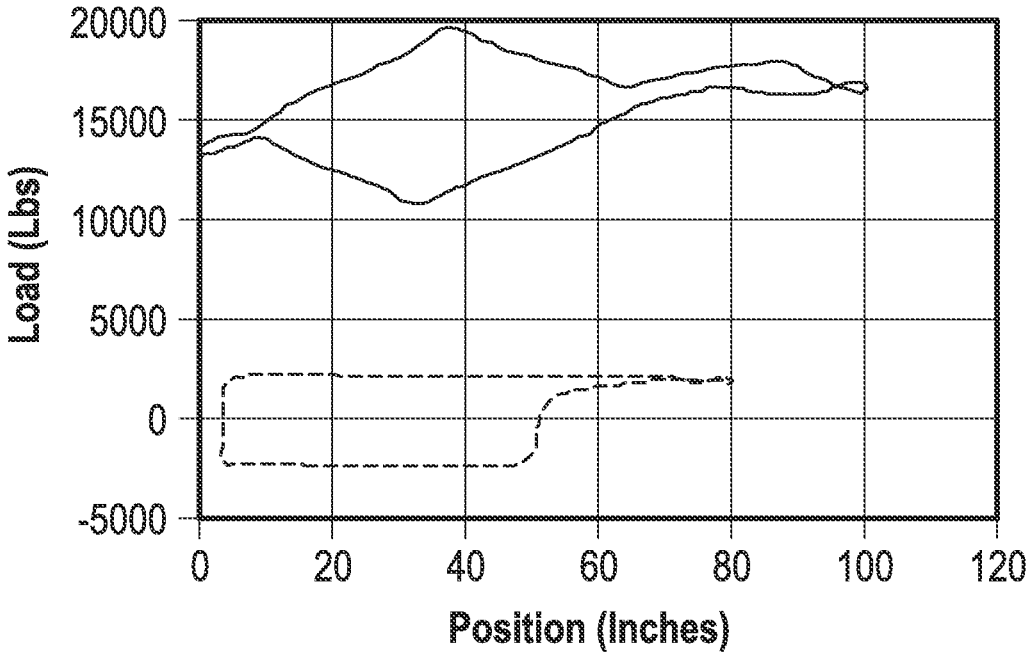
FIG. 15 illustrates the surface and pump cards with 60% fillage.
Figure 16:
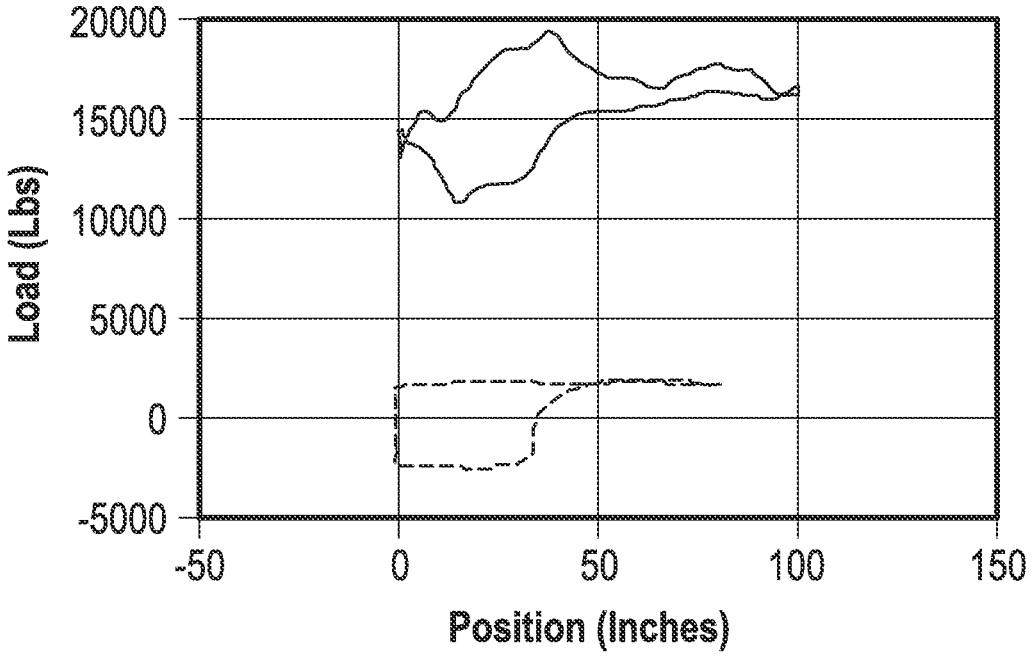
FIG. 16 illustrates the surface and pump cards with 40% fillage.
Figure 17:
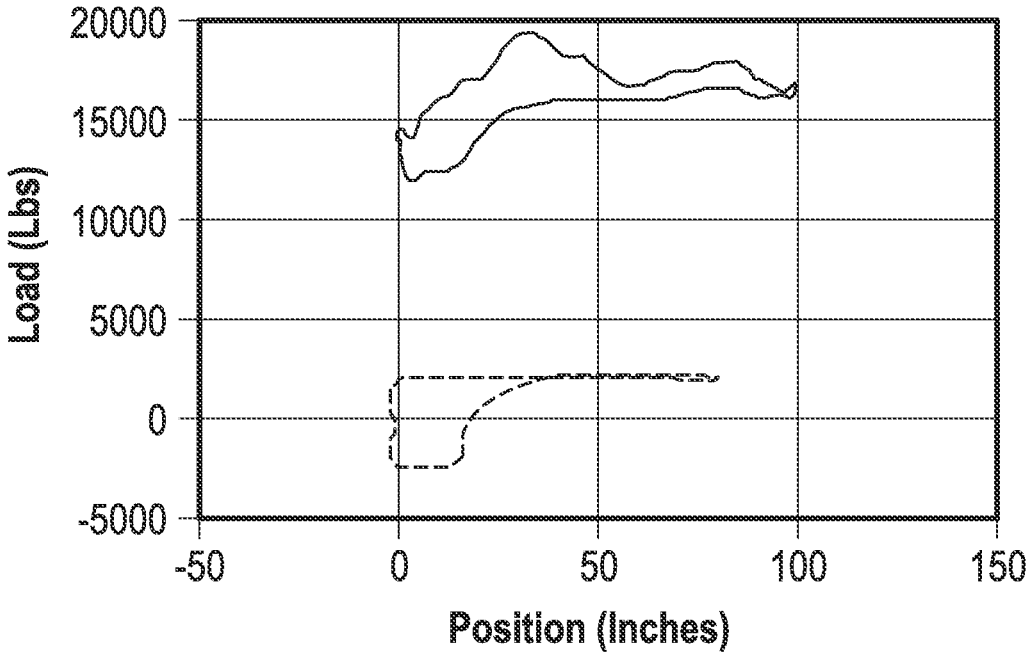
FIG. 17 illustrates the surface and pump cards with 20% fillage.
Figure 18:
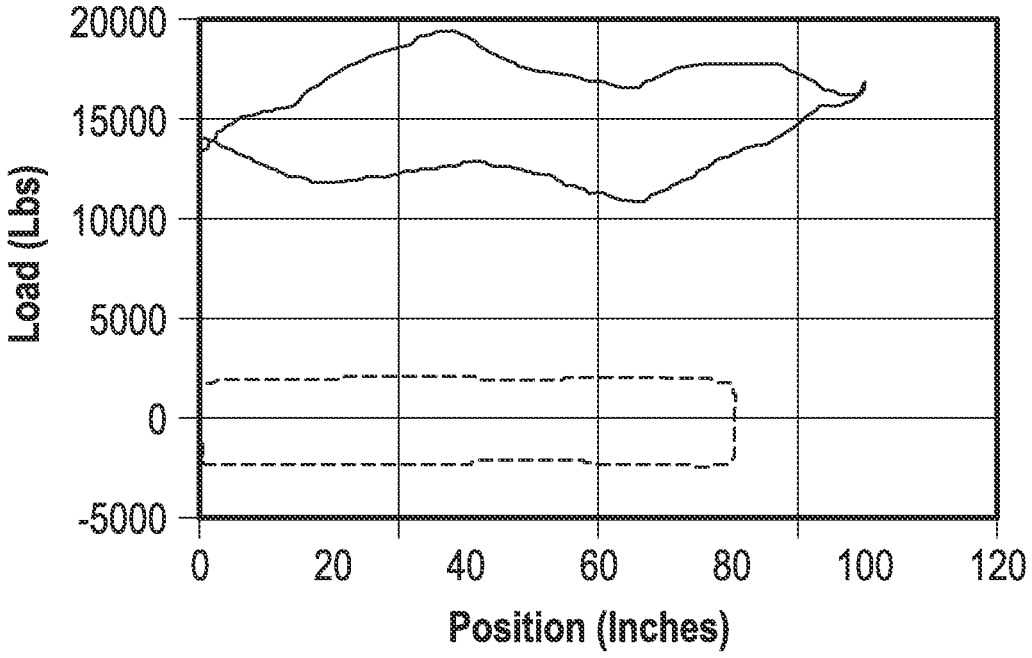
FIG. 18 illustrates the surface and pump cards with 100% fillage.

Successful diagnosis of large variations of pump fillage may be the necessary function for the real-time pump diagnostic. In this disclosure, SROD was used to synthesize the polished rod position and load as shown in FIG. 12. The well parameters are listed in Table 1. The pump has 100% fillage in the first stroke, 80% fillage in the second stroke, 60% fillage in the third stroke, 40% fillage in the fourth stroke, 20% fillage in the fifth stroke, and 100% fillage in the last stroke. The Fourier series real-time diagnostic method is used. The propagation delay is considered. The surface card with 100% fillage in the first stroke is shown in FIG. 13 and the pump card is not available. The surface and pump cards with 80% fillage are shown in FIG. 14. The surface and pump cards with 60% fillage are shown in FIG. 15. The surface and pump cards with 40% fillage are shown in FIG. 16. The surface and pump cards with 20% fillage are shown in FIG. 17. The surface and pump cards with 100% fillage are shown in FIG. 18. The simulation results show that our real-time diagnostic techniques are capable of detecting the large fillage variations (e.g., 20% and 80% fillage variations). Furthermore, the number of the data points of these strokes are slightly different from each other. For example, these six strokes have the 200, 190, 200, 210, 200, and 210 data points, respectively. The simulation results show that our real-time pump diagnostic techniques can handle the varying number of data points of a stroke.

Figure 19:
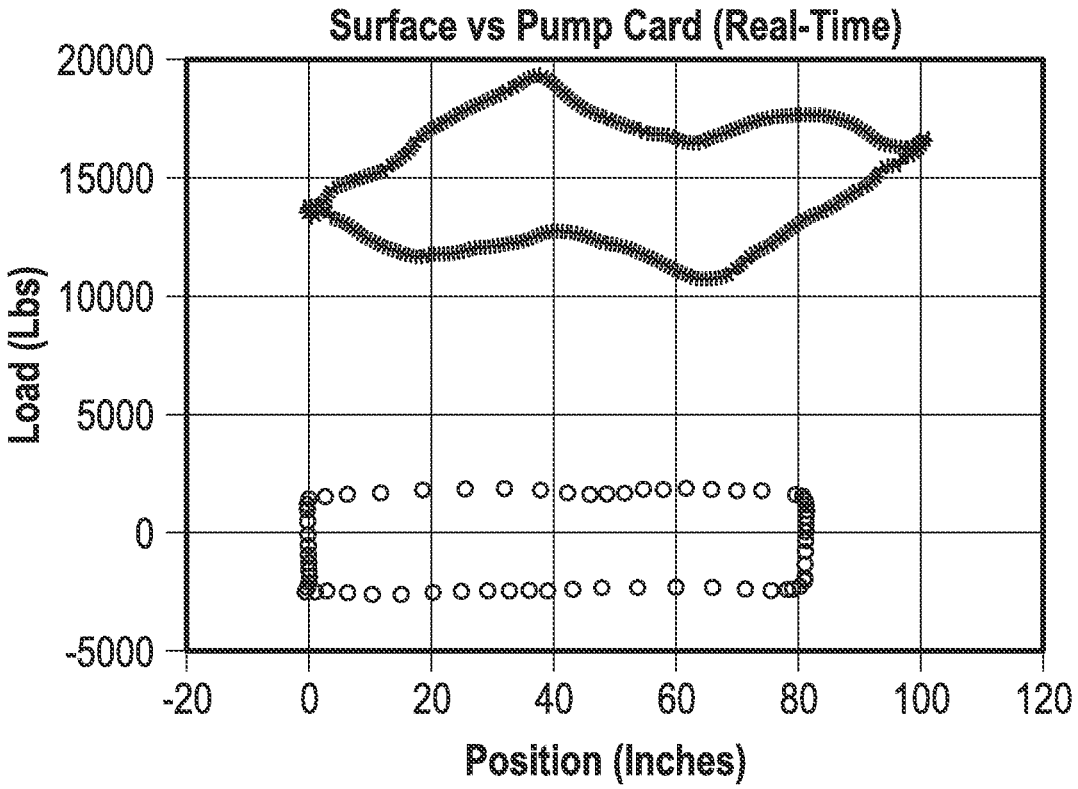
FIG. 19 illustrates the surface and pump cards that are generated by skipping every two surface data points.

Full execution of the real-time pump diagnostic algorithm may need dozens of milliseconds for a modern microcontroller. The algorithm execution time must be shorter than the sampling time interval. For fast pumping with short sampling intervals, we may skip a few surface data points so that we have enough time to execute the real-time diagnostic algorithm. For example, if we skip every two surface data points with the Fourier series method, we may have a real-time pump card as shown in FIG. 19 for the parameters as shown in Table 1. The surface data is synthesized from SROD. FIG. 19 shows that our real-time pump diagnostic algorithm is still valid even if every few surface data points are skipped.

This disclosure addresses the issue o determining the "real" delay time of the real-time pump motion relative to the real-time polished rod motion. The disclosed method for determining the delay time may work for both the finite difference method and the Fourier series method. Both methods generate a similar motion delay time for the pump relative to the polished rod.

Other and further embodiments utilizing one or more aspects of the inventions described above can be devised without departing from the spirit of Applicant's invention. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A method for determining a pump card for a well, the method comprising:

obtaining a first set of data points, wherein the first set of data points comprise a first set of polished rod position data points of the well and a first set of polished rod load data points of the well;

calculating a first data point of a pump position and a pump load using the first set of data points;

displaying the first set of data points, the display comprising a first surface card; and displaying, in real-time or near real-time, the first data point of the pump position and pump load synchronized with the display of the first surface card, wherein the calculating occurs before the well moves through a first complete stroke cycle, and wherein displaying in real-time or near real-time is ten seconds or less.

2. The method of claim 1, further comprising: obtaining a second set of data points comprising one or more of the polished rod position data points of the well and one or more of the polished rod load data points of the well during a second stroke cycle; calculating an additional data point of the pump position and pump load using the second set of data points;

displaying the second set of data points, the display comprising a second surface card; and displaying in real-time or near real-time the additional data point of the pump position and pump load synchronized with the display of the second surface card.

3. The method of claim 1, further comprising diagnosing the condition of the well.

4. The method of claim 1, where calculating comprises applying a finite difference method.

5. The method of claim 1, wherein the calculating a first data point of a pump position and pump load using the data points of the first set of data points comprises calculating a first data point of a pump position and pump load using the last 2N−3 data points of the first set of data points.

6. The method of claim 1, further comprising applying a wave propagation delay time technique.

7. The method of claim 1, further comprising stopping the pumping unit.

8. The method of claim 1, further comprising changing the speed of the pumping unit.

9. A method for generating a pump card for a well, the method comprising:

obtaining a first set of data points, wherein the first set of data points comprise a first set of polished rod position data points of the well and a first set of polished rod load data points of the well;

calculating a first data point of a pump load and a pump position using the first set of data points;

displaying the first set of data points, the display comprising a first surface card;

displaying in real-time or near real-time the first data point of the pump position and pump load synchronized with the display of the first surface card, wherein in real-time or near real-time is ten seconds or less;

deleting the oldest data point of the first set of data points to create a revised first set of data points;

obtaining an additional data point, wherein the additional data point comprises an additional polished rod position data point of the well and additional polished rod load data point of the well;

creating a second set of data points, wherein the second set of data points comprise the revised first set of data points and the additional data point; and calculating an additional data point of the pump position and pump load using the second set of data points.

10. The method of claim 9, further comprising:

displaying the additional data point; and displaying in real-time or near real-time the first data point of the pump position and pump load synchronized with the display of the additional data point.

11. The method of claim 9, further comprising diagnosing the condition of the well.

12. The method of claim 9, where calculating comprises applying a Fourier series algorithm.

13. The method of claim 9, further comprising applying a wave propagation delay time technique.

14. The method of claim 9, further comprising stopping the pumping unit or changing the speed of the pumping unit.

* * * * *